US005836829A

United States Patent [19]

Van Cott et al.

[11] Patent Number: 5,836,829

[45] Date of Patent: Nov. 17, 1998

[54] GOLF SWING TRAINING DEVICE

[76] Inventors: Robert Van Cott, 21 Peachtree La., Mt. Sinai, N.Y. 11766; John E. Campo, 2348 Cedar La., Secane, Pa. 19018

[21] Appl. No.: 823,832

[22] Filed: Mar. 25, 1997

[51] Int. Cl.[6] ..... A63B 69/36

[52] U.S. Cl. ..... 473/224; 473/234

[58] Field of Search ..... 473/220, 223, 473/224, 234

[56] References Cited

U.S. PATENT DOCUMENTS

| | | | |
|---|---|---|---|
| 3,792,863 | 2/1974 | Evans . | |
| 3,806,131 | 4/1974 | Evans . | |
| 3,945,646 | 3/1976 | Hammond . | |
| 4,306,722 | 12/1981 | Rusnak . | |
| 5,169,151 | 12/1992 | Conley | 473/220 |
| 5,277,428 | 1/1994 | Goodwin et al. | 473/224 |
| 5,401,030 | 3/1995 | Halliburton . | |
| 5,435,561 | 7/1995 | Conley | 473/224 |
| 5,482,283 | 1/1996 | Wall . | |
| 5,575,719 | 11/1996 | Gobush et al. . | |

*Primary Examiner*—George J. Marlo
*Attorney, Agent, or Firm*—Hoffman, Wasson & Gitler

[57] ABSTRACT

A golf swing training device. The training device provides audible indications of the orientation of the club face as it reaches a point where a ball would be positioned, thereby helping a golfer develop a swing where the club face meets the ball squarely. The audible indication tell the golfer if the club face is open, closed, or square to the ball at the moment of impact. An unsmooth swing can be detected during upswing or downswing, and an indication of such is provided. A pendulum is provided in the club head with a pair of sensors located on either side of the pendulum to sense the position of the pendulum. A velocity switch senses the peak velocity of the club and activates an electronic circuit at that point so that outputs of the pair of sensors provide data which indicate the orientation of the club face at the moment of peak velocity. The audible indication of the club orientation is provided based upon the output of these sensors.

28 Claims, 13 Drawing Sheets

| A3 | A6 | OUTPUT |
|---|---|---|
| L | L | STRAIGHT |
| L | H | SLICE |
| H | L | HOOK |
| H | H | UNSMOOTH |

GOLF SWING TRAINING DEVICE

BACKGROUND OF THE INVENTION

1. Field of the Invention

The present invention relates to a golf swing training device. More particularly, the present invention relates to a training device which provides audible indications of the orientation of the club face as it meets the ball and smoothness throughout the swing, thereby helping a golfer develop a smooth swing where the club face meets the ball squarely.

2. Description of the Prior Art

Various devices have been developed to help golfers improve their swing. Most of the devices are complicated and require a significant amount of equipment. Some of the equipment, when set up, creates a situation which does not resemble an actual golf swing. Furthermore, the required equipment can be complicated, and includes light beams, alignment devices, and a great deal of external equipment around the golf tee or practice area. For example, U.S. Pat. No. 3,945,646 to Hammond discloses an athletic swing measurement system and method. A club transmits data to a separate console where the signals are processed to provide indicia representative of the swing, such as the club face position. In addition to the external console, the system requires an FM transmitter in the club and a receiver in the console.

Many devices require the user to actually hit a golf ball. To do so the device needs to be used outdoors or at a driving range. U.S. Pat. Nos. 4,306,722 and 5,575,719 to Rusnak and Gobush, et al., respectively, both require both external equipment and an actual impact with a golf ball.

U.S. Pat. No. 5,482,283 to Wall shows a golf club which emits light beams in order to aid in proper orientation of the club face. The light beams are intended to impinge on an actual golf ball.

A couple of patents disclose devices which employ pendulum-type sensors to sense forces relating to club misalignment during a golf swing. U.S. Pat. No. 5,082,283 to Conley et al. discloses an electromechanical swing trainer, and has a pendulum located within the grip area. The pendulum is oriented so that it is parallel to club shaft it is housed within. The Conley device does not provide an output indicating the club head orientation at the instant of intended impact, but rather utilities the centrifugal force of a proper swing to disconnect the circuit. The circuit output is used as a negative feedback so that it provides no signal during any part of a properly executed golf swing. The conley device only provides alarm information during an improperly executed golf swing. For training purposes, it is important to provide the user with positive feedback about a properly executed golf swing when everything is done correctly.

U.S. Pat. No. 5,441,269 to Henwood also employs a pendulum sensor oriented to swing along the path of club head travel to sense a non-pendulum-type putting stroke. The Henwood device requires an actual impact with a golf ball in order to detect club face alignment. In such a case, it is just as helpful to watch the motion of the ball as it is to observe the LED indicators on the club. Furthermore, the Henwood device requires a complex mechanism and electronics to create the required feedback.

SUMMARY OF THE INVENTION

These and other deficiencies of the prior art are addressed by the present invention which is directed to a golf swing training device which has the same size and weight as a standard driver. An embodiment of the device can emit four distinct sounds which provide the golfer with instantaneous information concerning the smoothness throughout the swing and the orientation of the club face relative to the ball at the point of impact. The four distinct sounds correspond to a hook, a slice, a straight drive, and an unsmooth swing. The sounds are produced by an integrated circuit chip. If the golfer's swing is correct and true, the trainer produces a sound like a golf ball being struck. If a slice or hook would have occurred, due to improper club head orientation, the trainer produces a rising or falling pitch whistle or other sound, respectively. If there is excessive acceleration during the backswing or downswing, then a distinct sound is emitted which indicates an unsmooth swing. A ball is not necessary for the trainer to operate.

A second embodiment of the present invention is completely mechanical in nature, and provides the user with an audible sound when the club face is perpendicular to the swing path at the intended point of impact.

The pendulum of the present invention is oriented differently from the devices disclosed in Conley and Henwood, and therefore senses different forces during the same type of swing.

An object of the present invention is to provide a golf swing training device having the same size and weight as a standard golf driver.

Another object of the present invention is to provide a golf swing training device which provides an audible indication of the orientation of the golf club face at a point of impact with a ball.

Yet another object of the present invention is to provide a golf swing training device which does not require a ball or an actual impact with a ball for proper operation.

Still another object of the present invention is to provide a golf swing training device which senses club acceleration.

Another object of the present invention is to provide a golf swing training device which senses excessive acceleration of the club due to an unsmooth backswing or downswing.

Yet another object of the present invention is to provide a golf swing training device which senses the orientation of the club face at a point of peak velocity.

Another object of the present invention is to provide a golf swing training device which provides an audible indication of the orientation of the golf club face at a point of impact with a ball, and indicates the degree to which the club face is open or closed.

Still another object of the present invention is to provide a golf swing trainer which provides the user with indications of a properly executed swing.

Another object of the present invention is to provide a golf swing trainer which is either electromechanical or mechanical in nature.

BRIEF DESCRIPTION OF THE DRAWINGS

These and other objects and attributes of the present invention will be described with respect to the following drawings in which.

DETAILED DESCRIPTION OF THE INVENTION

Figure 1:
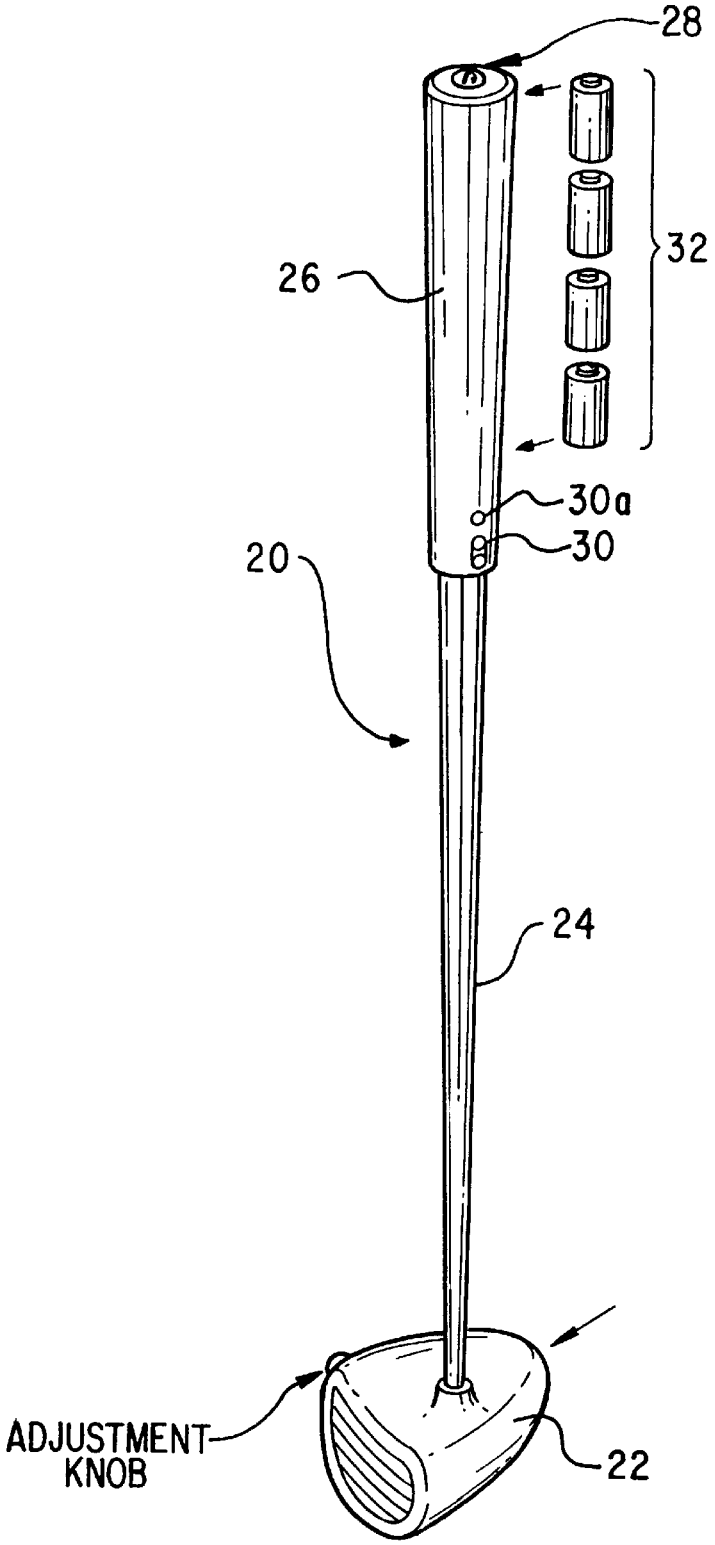
FIG. 1 is a perspective view of the golf swing training device according to the present invention.

Referring to FIG. 1, the golf swing training device 20 of the present invention has the size, weight and balance of a normal driver. The swing training device will be available in a variety of sizes depending upon the size of the golfer. The swing trainer 20 includes a club head 22, and shaft 24 and a grip 26. An unobtrusive On/Off switch 30 and LED power indicator are provided near the bottom of the grip 26, and connects and disconnects power from a power source, such as batteries 32, contained inside the grip 26.

The batteries 32 in the illustrated embodiment are four size a—a batteries, and are inserted through an opening 28 in the end of the grip 26. The batteries 32 are contained by top 29, which screws into the opening 28. An adjustment screw 44 is also provided.

Figure 2:
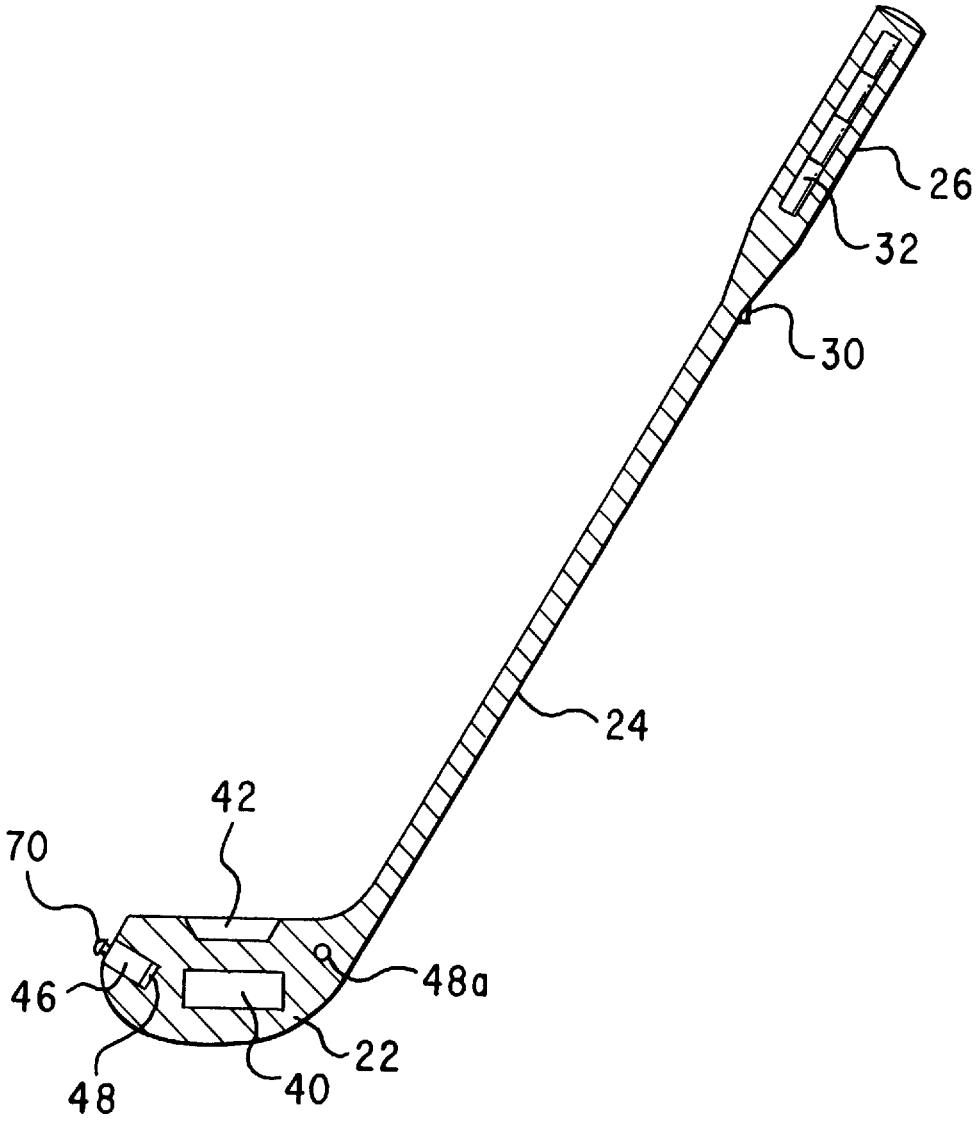
FIG. 2 is a cross-sectional view taken along line A—A of FIG. 1 of the golf swing training device shown in FIG. 1.
Figure 3:
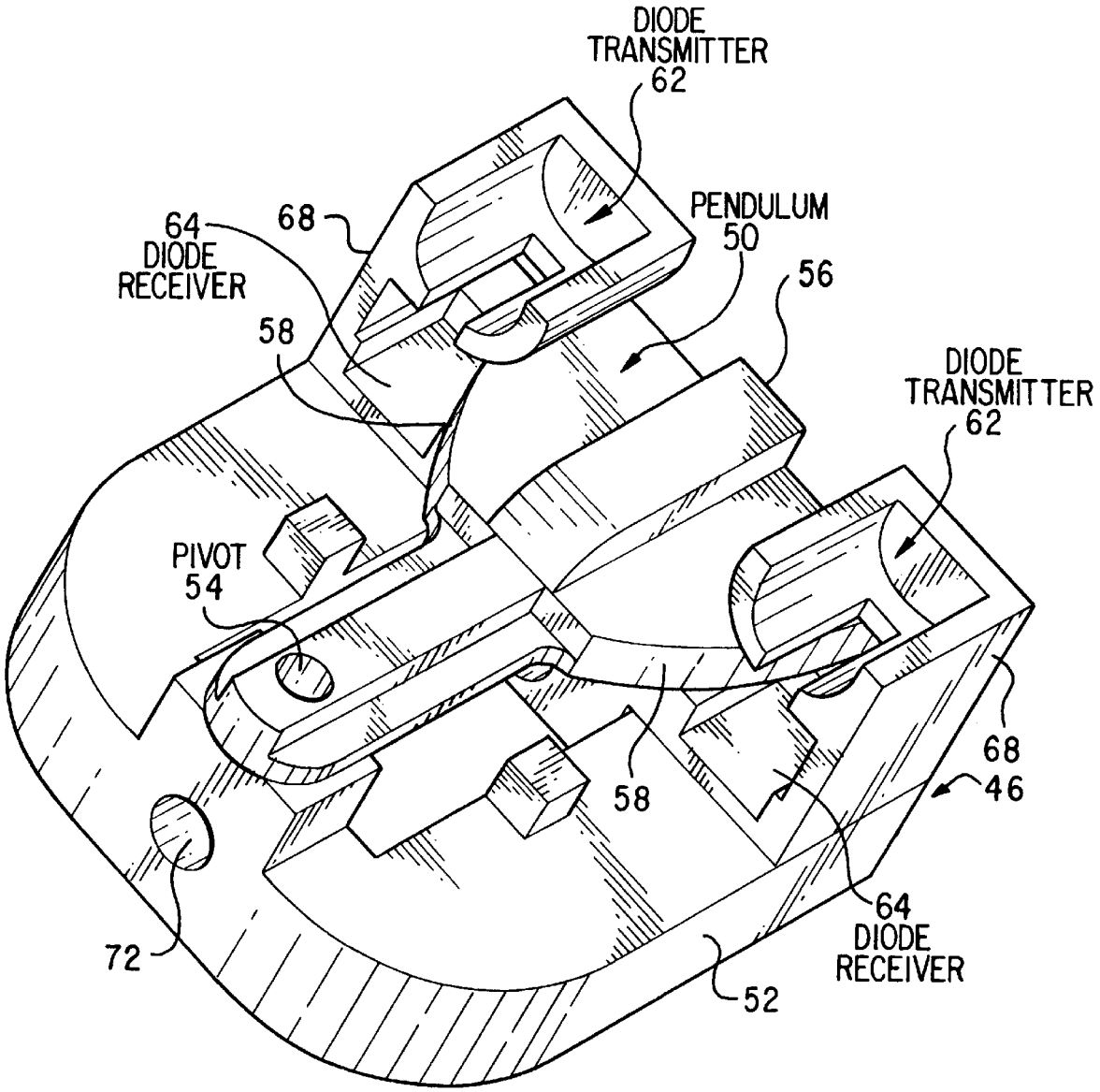
FIG. 3 is a perspective view of a pendulum for the golf sawing trainer of the present invention.
Figure 4:
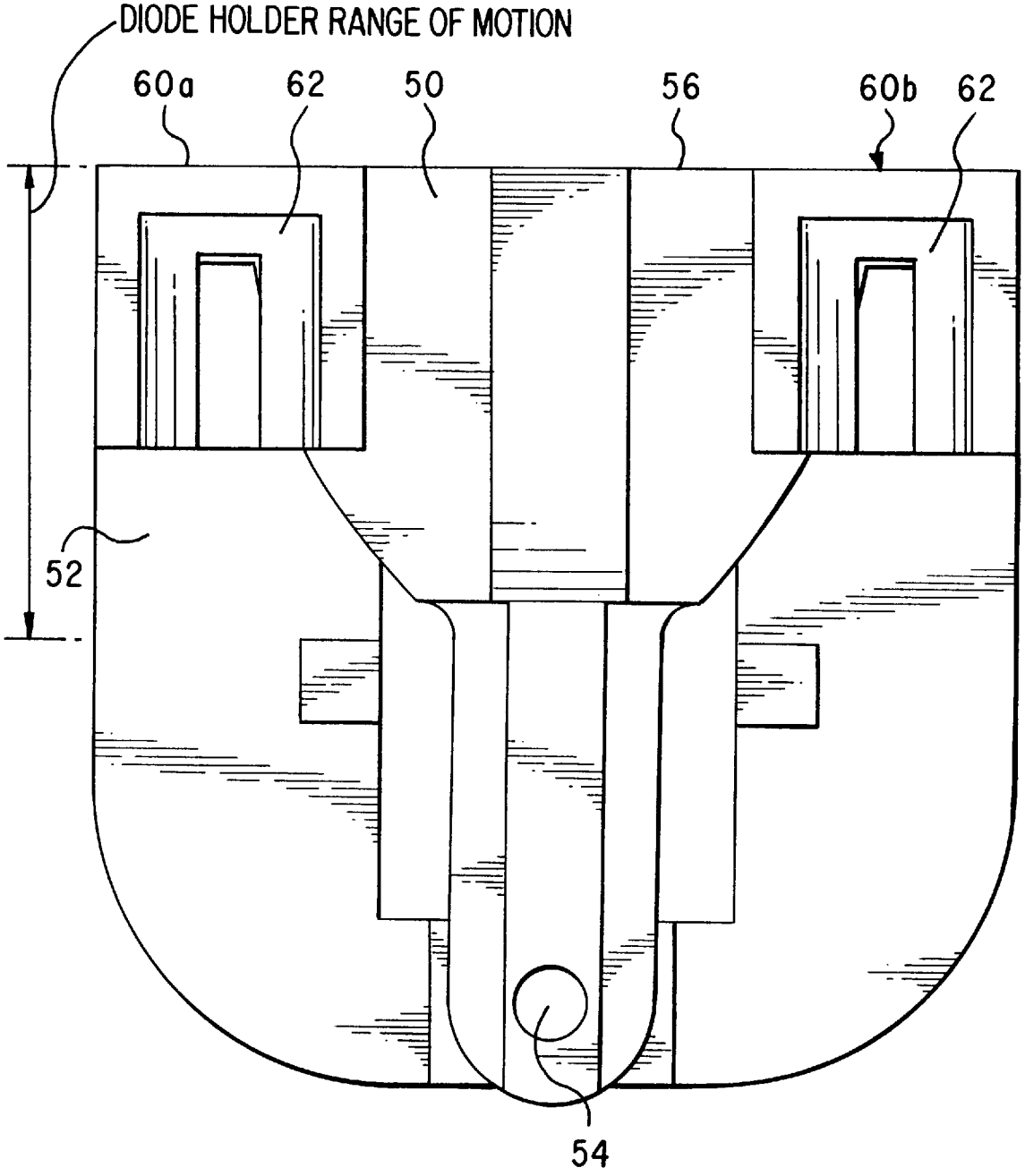
FIG. 4 is a top plan view of the pendulum of FIG. 3.
Figure 5:
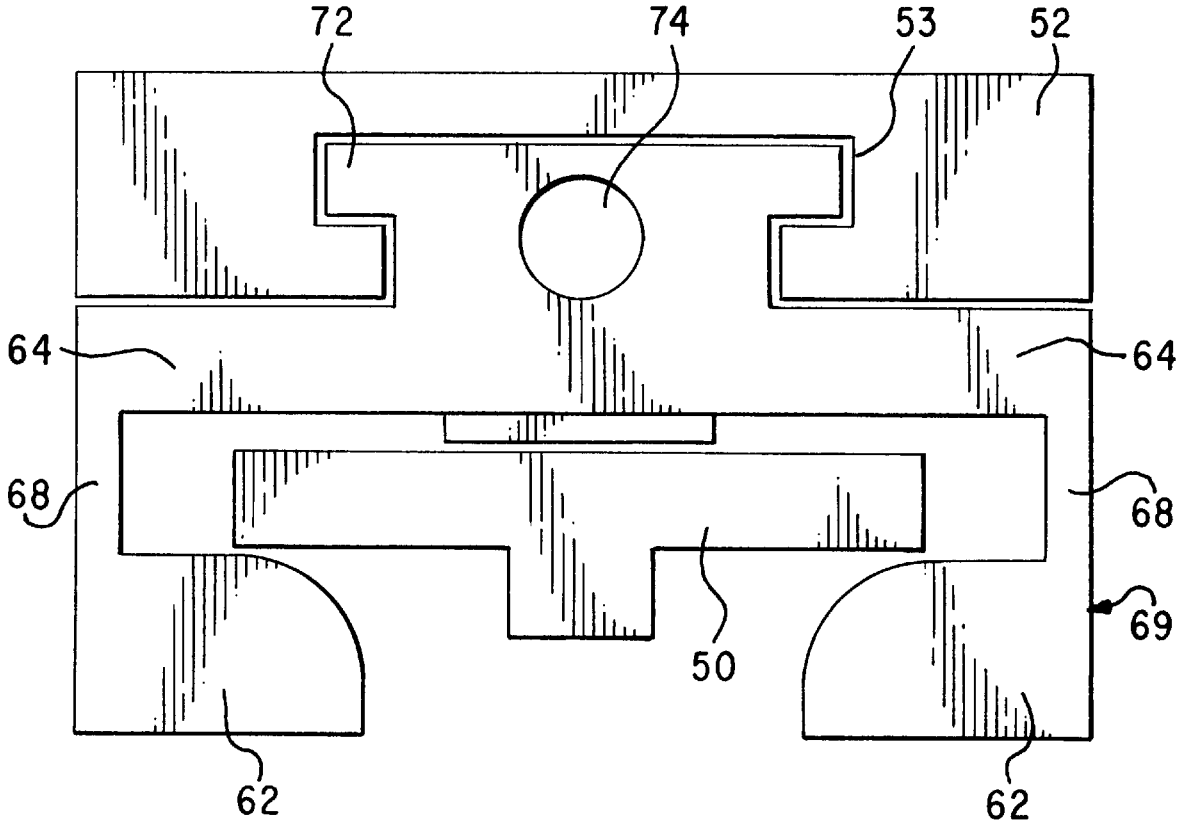
FIG. 5 is a front view of the pendulum illustrated in FIG. 3.
Figure 6:
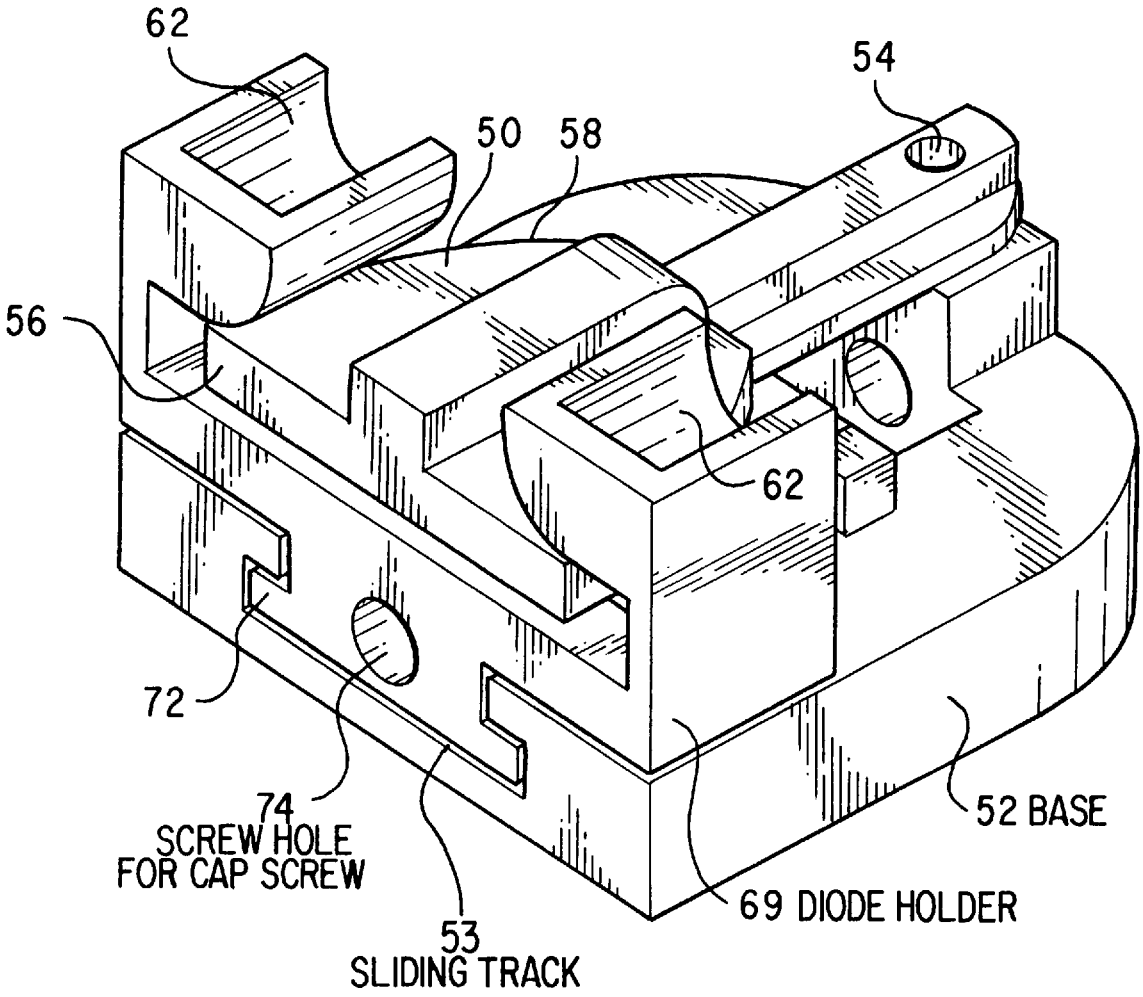
FIG. 6 is a second perspective view of the pendulum shown in FIG. 3.

The power from the batteries is delivered to sensors and electronics, discussed below, which are contained in the club head 22. As shown in FIG. 2, the club head 22 contains an electronics module 40, a speaker 42, an adjustment knob 70, a swing arm sensor 46, velocity switch 48, and smoothness circuit 48*a* made up of two accelerometers disposed parallel to the swing path of the club and sensing in opposite directions. The velocity switch 48 is located close to the swing arm sensor 46 and is made up of two accelerometers perpendicular to one another. While the illustrated embodiment shows the circuitry and electromechanics inside the clubhead, the entire structure can be located external to the clubhead.

The swing arm sensor 46 will now be described in detail with reference to FIGS. 3–6 and 17. The swing arm sensor 46 includes a pendulum 50 attached to a base 52 through a pivot 54. The pendulum 50 is designed to be as friction-free as possible. The width of the pendulum 50 increases from the pivot 54 to the free end 56. In the illustrated embodiment the increase in width of the pendulum 50 is due to the angled edges 58. A pair of sensors 60 are provided, one each on either side of the free end 56 of the pendulum 50. A sensor 60*a* is located on the side of the pendulum 50 closer to the club face, and sensor 60*b* is located on the side of the pendulum 50 farther from the club face.

The sensors 60 each include a diode transmitter 62 and a diode receiver 64. In the illustrated embodiment the diode receivers 64 are disposed in the base 52 and the diode transmitters 62 are disposed directly opposite, on the other side of the free end 56 of the pendulum 50. The locations of the diode receivers 64 and transmitters 62 can be reversed. The diode transmitters 62 are supported by support arms 68, extending from the base 52, so that the diode transmitters 62 and diode receivers 64 are aligned with one another. In the preferred embodiment diode transmitters and diode receivers are employed, but other sensors may be used in their place.

When the power to the swing training device is on and velocity switch 48 is closed, the diode receivers 64 receive light from their respective diode transmitters 62. When the pendulum 50 oscillates about pivot 54, the wider free end 56 will swing back and forth. The movement of the free end 56 will, if the movement of the pendulum 50 is great enough, interfere with the reception of the light from the diode transmitters 62 by the diode receivers 64. Such interference, and which diode transmitter is being interfered with plays a key roll in the operation of the swing trainer of the present invention.

The sensitivity of the pendulum 50 is adjustable via an adjustment screw 70. As shown in FIGS. 3–6, the support arms 68 are integrally formed as parts of a diode holder 69. The base 52 has a sliding track 53 formed in its upper face, and the diode holder 69 has a corresponding protrusion 72 which interfits with the sliding track 53, so that the position of the diode holder 69 can be changed relative to the base 52 and the pivot 54. The position of the diode holder 69 is changed by turning a screw 70 which fits in threaded hole 74 in the end of the diode holder 69. By turning the screw 70 the diode holder 69 moves towards or away from the pivot 54. Since the sides of the pendulum 50 are angled, the degree to which the pendulum 50 will interfere with the reception of light by the diode receivers 64 decreases as the diode holder 69 is moved closer to the pivot 54.

As a result of the foregoing configuration, the user can easily alter the sensitivity of the golf swing trainer 20. As the user's skill increases, the sensitivity of the trainer 20 can be increased by turning the screw to move the diode holder 69 away from the pivot 54. In this manner, the degree to which the club head can vary from an orientation perpendicular to the swing path of the golf club, without causing a slice or hook audible warning, decreases. The trainer 20 can be adjusted so that there is no leeway, and only when the user maintains the club face in the exact orientation, will the trainer 20 emit an audible indication of a ball being struck.

Figure 7:
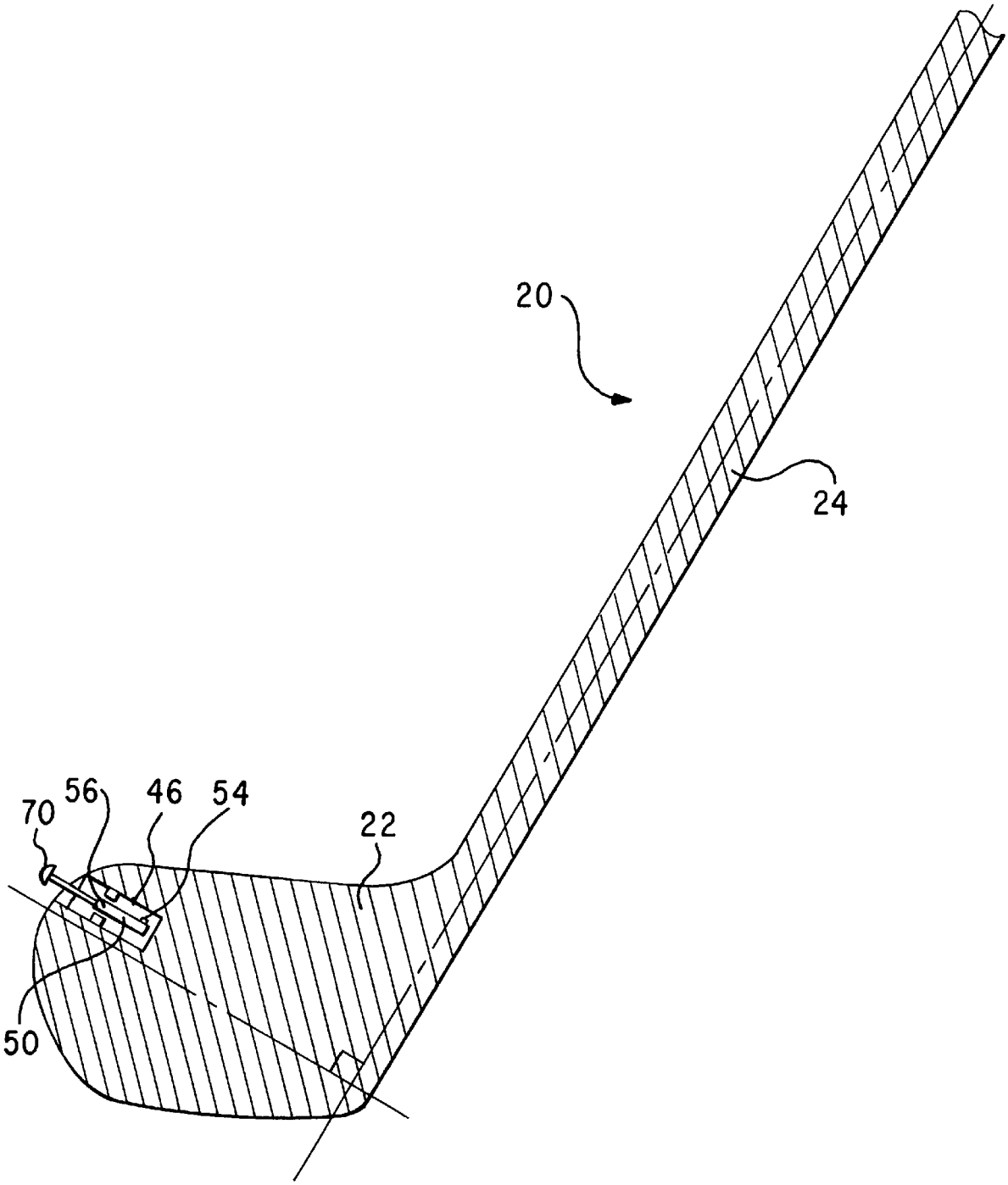
FIG. 7 is a cross-sectional view, similar to FIG. 2, and shows the location of the pendulum of FIG. 3.

Referring to FIG. 7, the lower portion of the training device 20 of the present invention is shown in cross-section. The pendulum 50 is located in the club head 22, and lies in a plane perpendicular to the axis of the club shaft 24. In the preferred embodiment, the pivot 54 is spaced approximately 2.0" away from the axis of the shaft 24, and the pendulum 50 has a length of approximately 1". The pivot end 54 of the pendulum 50 is closer to the shaft 24 than the free end 56 of the pendulum 50.

The swing trainer of the present invention utilizes the unique dynamics of a golf swing. During the final 90 degrees of downswing, from a position parallel to the ground to just before impact with a golf ball, a golf club is rotated approximately 90 degrees around the shaft axis in the plane of the swing path. As a result, in the swing trainer of the present invention, the pendulum 50 will swing out due to the centrifugal force due to the rotation around the club shaft axis. The orientation of the pendulum 50 causes it to be insensitive to the major centrifugal force component acting along the club shaft axis. During the golf swing, the club is accelerating up to the point of an impact, where it begins deceleration. Since the acceleration is 0 at impact, perpendicular to the shaft axis, the resultant force on the pendulum 50 is due only to rotation around the axis of shaft 24.

Centrifugal force causes the pendulum 50 to oscillate around a force vector, if there is an initial offset. The initial offset is caused by initial force at the 90 degree point prior to impact (which occurs approximately 0.04 seconds prior to impact.)

An inside-out swing and/or closed face swing results in the pendulum 50 swinging negative, resulting in a hook output. Such an output causes a low signal to A3 (PIN 5) in FIGS. 10*a* and 10*b*, which results in a hook output from the I.C. circuit 100.

An outside-in swing and/or closed faced swing results in the pendulum 50 swinging positive, causing a slice output. Such a slice output causes a low signal to A6 (PIN 8) which in turn causes a slice output from the I.C. circuit 100.

A straight swing results in the pendulum swinging to the center which causes both A6 and A3 (PINS 8 and 5, respectively) to be low, thereby causing a straight signal output.

Figure 8:
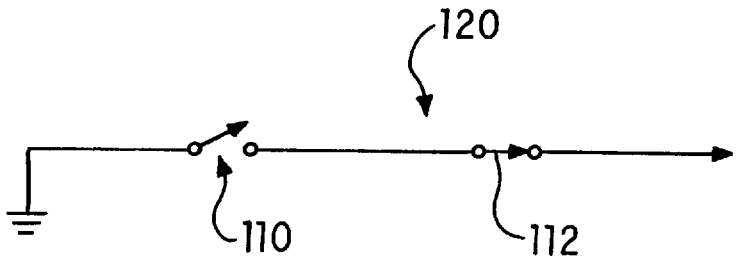
FIG. 8 is circuit representation of a velocity switch according to the present invention.

The pendulum circuit is coupled to a velocity switch, as shown in FIG. 8, to produce an output signal corresponding to the peak maximum velocity and orientation of the club face. The system constants which are the pivot offset from the shaft, 2.0" in the preferred embodiment, and the effective pendulum length, 1" in the preferred embodiment, cause oscillations to result in peak output after approximately 0.04 seconds, which is the time from an initial condition where the club is parallel to the ground to the point of impact.

The swing trainer of the present invention includes at least two accelerometers 110 and 112, which are located in the club head to comprise a velocity switch 120. Accelerometer 110 is positioned parallel to the club shaft and senses the centrifugal force down the club shaft 24. The accelerometer 110 is normally in an open condition. Accelerometer 112 is positioned perpendicular to the club shaft and senses tangential force. The accelerometer 112 is normally closed.

Figure 9:
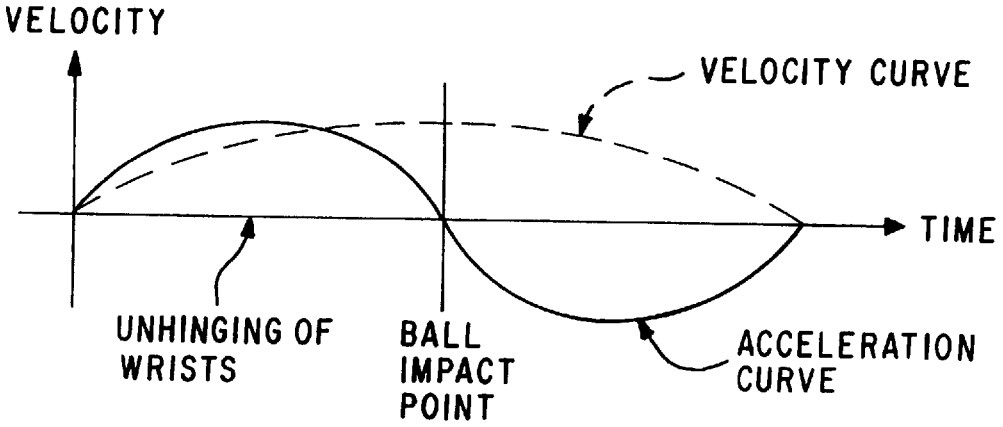
FIG. 9 is a waveform diagram of the acceleration of a golf club verses time.

Referring to FIG. 9, waveforms of the velocity and acceleration of the golf swing trainer 20 verses time are illustrated. From the start of the swing through the point where the golfer unhinges his or her wrists the acceleration increases during which time accelerometer 112 opens then accelerometer 110 closes. The acceleration of the club then decreases from the unhinging of the wrists through the point of normal ball impact. The velocity of the club increase from the start to a peak velocity at the point of normal ball impact. At the normal point of ball impact, the accelerometer 112 closes, and the velocity switch 120 provides a momentary ground to the I.C. circuit 100 at input $\overline{\text{PLAYE}}$, shown in FIG. 10*a*. The momentary grounding of the I.C. circuit 100, causes the I.C. circuit 100 to take a reading of the diode receivers 64 during such grounding. As a result the position of the pendulum 50 is determined at the normal point of ball impact. The audible indication from the swing trainer 20 depends upon the outputs of the sensors 60*a* and 60*b*. If sensor 60*a*, on the club face side of the pendulum 50 receives a signal between the diode transmitter and diode receiver, and the sensor 60*b* does not receive a signal between its diode transmitter and diode receiver, then the golfer's swing is hook and the proper audible indication is emitted. If sensor 60*b* , on the side of the pendulum 50 farther from the club face receives a signal between the diode transmitter and diode receiver, and the sensor 60*a* does not receive a signal between its diode transmitter and diode receiver, then the golfer's swing is a slice and the corresponding audible indication is emitted. If both sensors 60*a* and 60*b* receive their signals then the orientation of the swing is true and the audible sound of a ball being struck true is emitted.

Figures 10A, 10B:
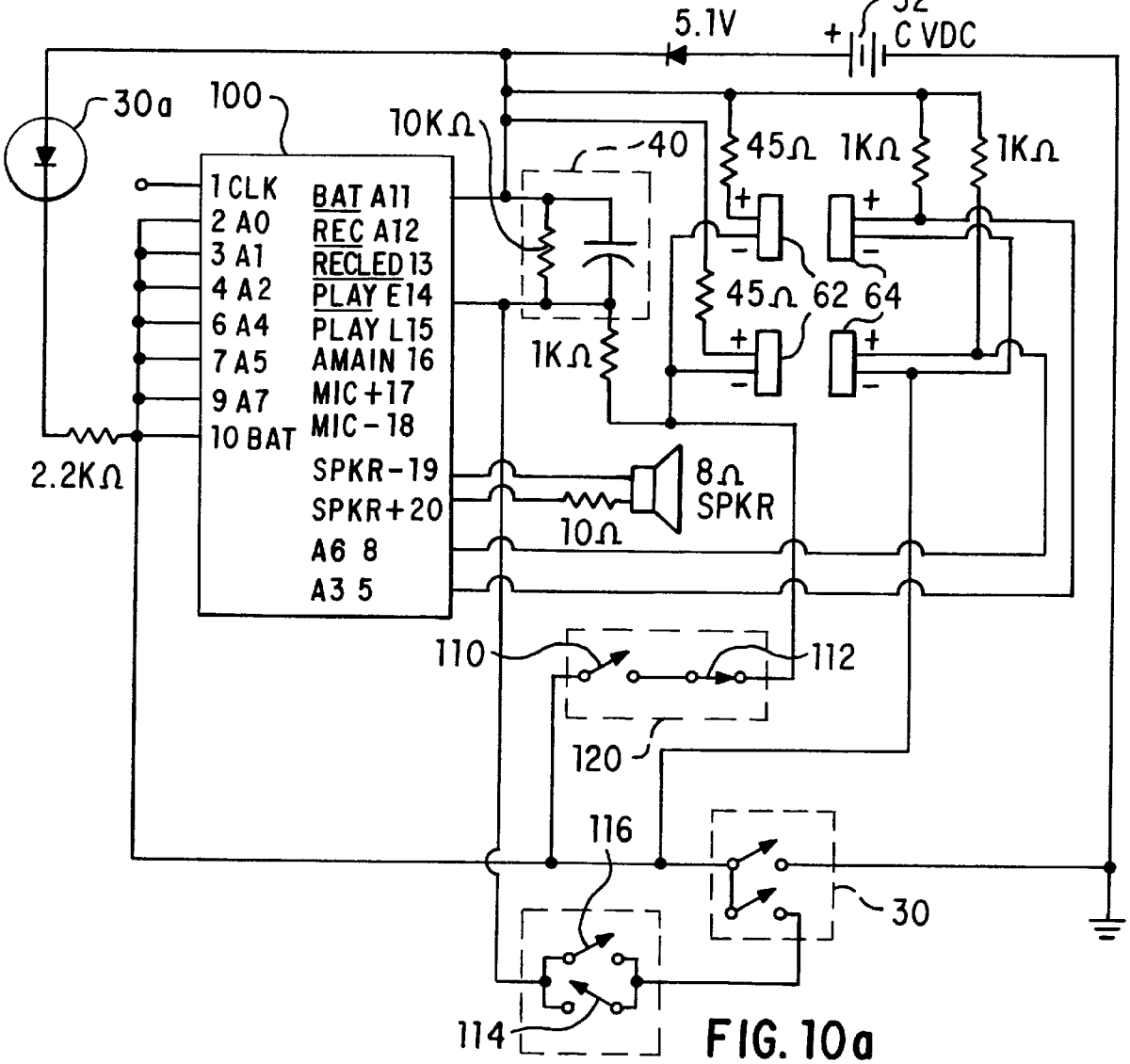
FIGS. 10*a* and 10*b* are a circuit diagram of the electronics of the present invention, and an output table, respectively.

Referring to FIG. 10*b*, an output table is shown with the inputs to address A3 and A6 of the I.C. circuit 100 and the corresponding output. When both sensors 60*a* and 60*b* receive their corresponding signals the inputs to A3 and A6 are both low, and straight strike sound is emitted. If sensor 60*b* is the only sensor 60 receiving a signal A3 is low and A6 is high, and a slice signal is provided. If sensor 60*a* is the only sensor 60 receiving a signal, then A3 is high and A6 is low, and a hook signal is emitted.

The swing trainer 20 of the present invention also makes use of a condition when neither sensor 60*a* nor 60*b* receives a signal. When a golfer's swing is jerky or not smooth, the velocity switch 120 is open, the accelerometers 110 and 112 do not perform their intended function, and no ground is provided to the diode transmitters 62 while smoothness circuit 130 provides momentary ground to I.C. 100 at input $\overline{\text{PLAYE}}$. The smoothness circuit 130 is made up of two open accelerometers 114 and 116 which sense accelerations along the swing path in the upswing and downswing directions, respectively. As a result, A3 and A6 are both high and an unsmooth swing output is made. Such an output can be audible, such as a distinct beep or sound, or visual such as a blinking light.

Normal operation involves simultaneous connection of transmitters 62, and therefor $\overline{\text{PLAYE}}$ is time delayed by an R-C circuit 140 to allow the address lines to settle. The time delay is approximately 0.002 seconds, during which time the club head 22 moves about 3.5" at 100 miles/hour. Therefore the time delay is not noticeable to the user of the swing trainer 20.

The sensors 60 may be an inductance, capacitance or a combination of both so that the degree of a slice or a hook can be measured. The user can thus get feedback as to how much hook or slice he or she has in their swing. Alternatively, the sensors 60 may have additional sensors located in the club head in a line parallel to the direction of pendulum swing. The degree to which a swing is open or closed will then be measured depending upon the number of sensors producing signals on either side of the pendulum 50. In an embodiment including such sensors for measuring the degree of hook or slice, the output would have to be modulated to indicate to the user the degree of hook or slice experienced if a golf ball were hit. Furthermore, no adjustment as to skill level as previously described would be necessary.

Referring to FIGS. 11–16, a second mechanical embodiment of the present invention is disclosed. The second embodiment includes no electronic components. While the second embodiment is simpler than the first embodiment, it does not provide as much information to the user. In particular, the second embodiment only provides an audible indication when the club is swung straight. No smoothness indicator is provided, and no indicator of a hook or slice is emitted.

Figure 11:
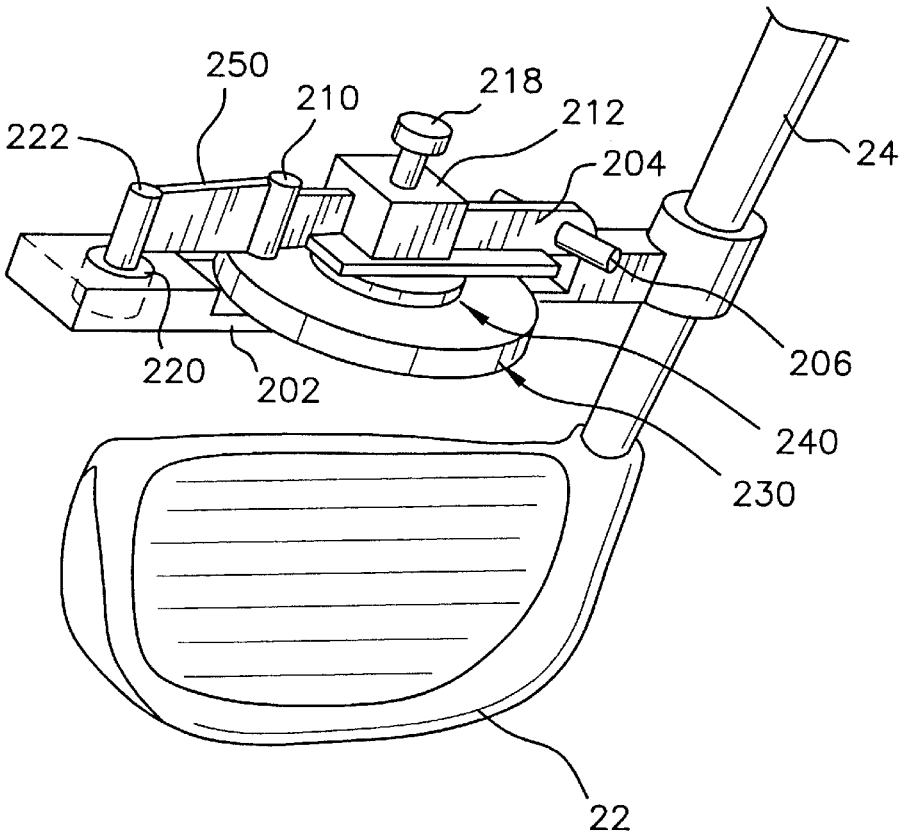
FIG. 11 is a perspective view of a second mechanical embodiment of the golf swing training device according to the present invention, where the device attaches to the club shaft above the club head.
Figure 12:
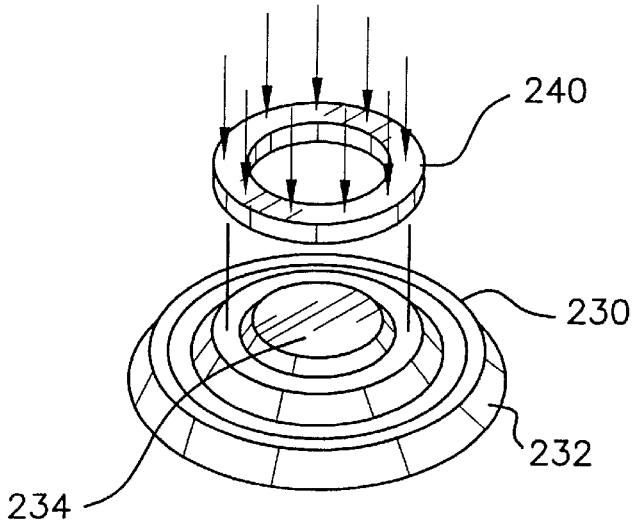
FIG. 12 is a perspective view of the ring and diaphragm of the device shown in FIG. 11.

FIG. 11 shows the mechanical swing trainer 200, of the second embodiment, where the trainer 200 is attached to the club shaft 24 of a golf club. While the drawings only show the mechanical trainer external to the club head 22, it is contemplated that the trainer 200 can be incorporated inside the club head 22 in a manner similar to the first embodiment. The trainer 200 is oriented so that it is parallel to the club head 22.

Figure 13:
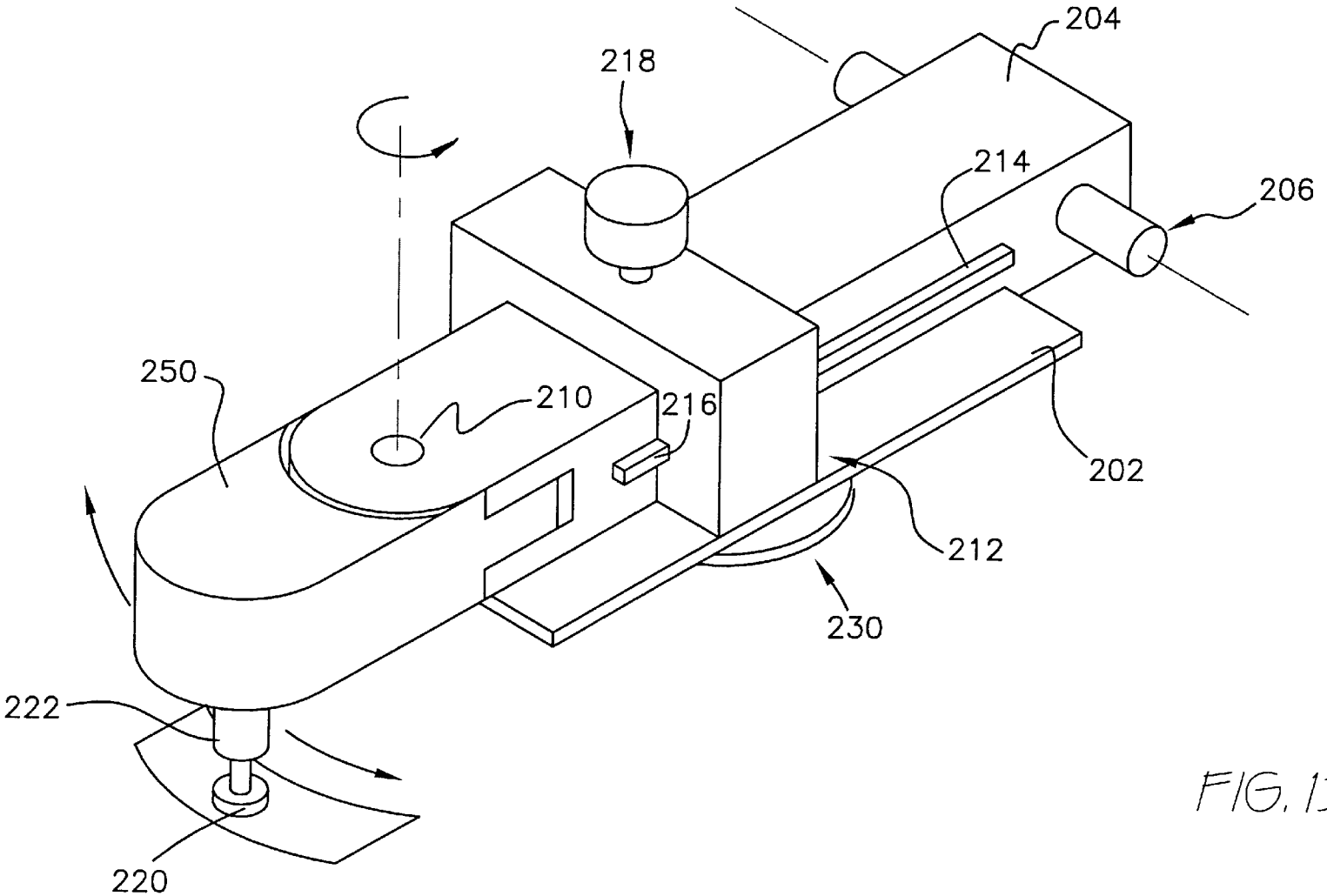
FIG. 13 is a close-up perspective view of second mechanical mechanism similar to the mechanism shown in FIG. 11.

The trainer will now be discussed in detail with reference to FIGS. 11 and 13. The trainer 200 includes and arm 202 which attaches to the shaft 24 and extends parallel to the club head 22. A fulcrum 204 is disposed on the arm 202 so that it can rotate about fulcrum bearing 206. The fulcrum bearing 206 is positioned near the end of the arm 202 closest to the shaft 24. A pendulum 250 is pivotable attached to the outer end 208 of the fulcrum 204 with a hinge 210.

A weight 212 is attached to the fulcrum 204 and can be moved toward or away from the shaft 24. The weight 212 is guided along the arm by rails 214 which extend from the sides of the fulcrum 204. The weight 212 has grooves 216 that mesh with the rails 214. The weight is held in place at a fixed location along the fulcrum 204 by tightening a set screw 218.

Figure 16:
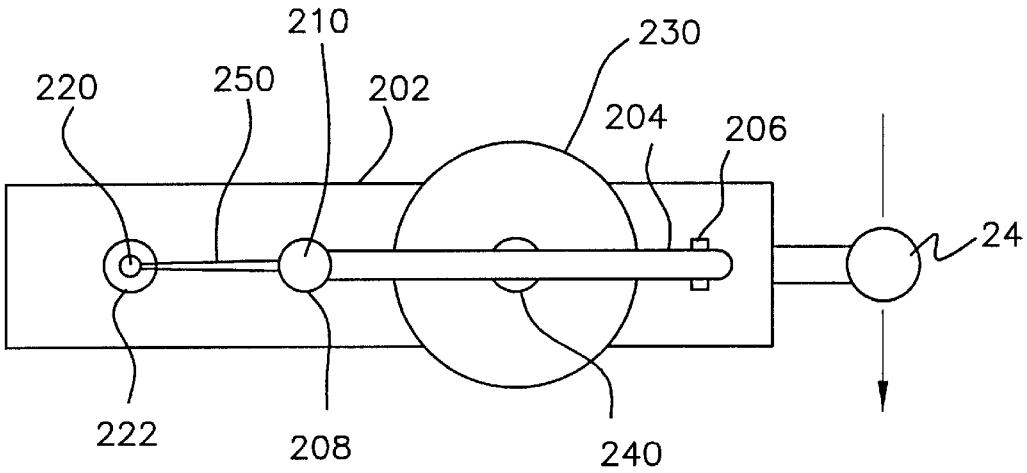
FIG. 16 is a top plan view of the device shown in FIG. 11 during straight swing.
Figure 17:
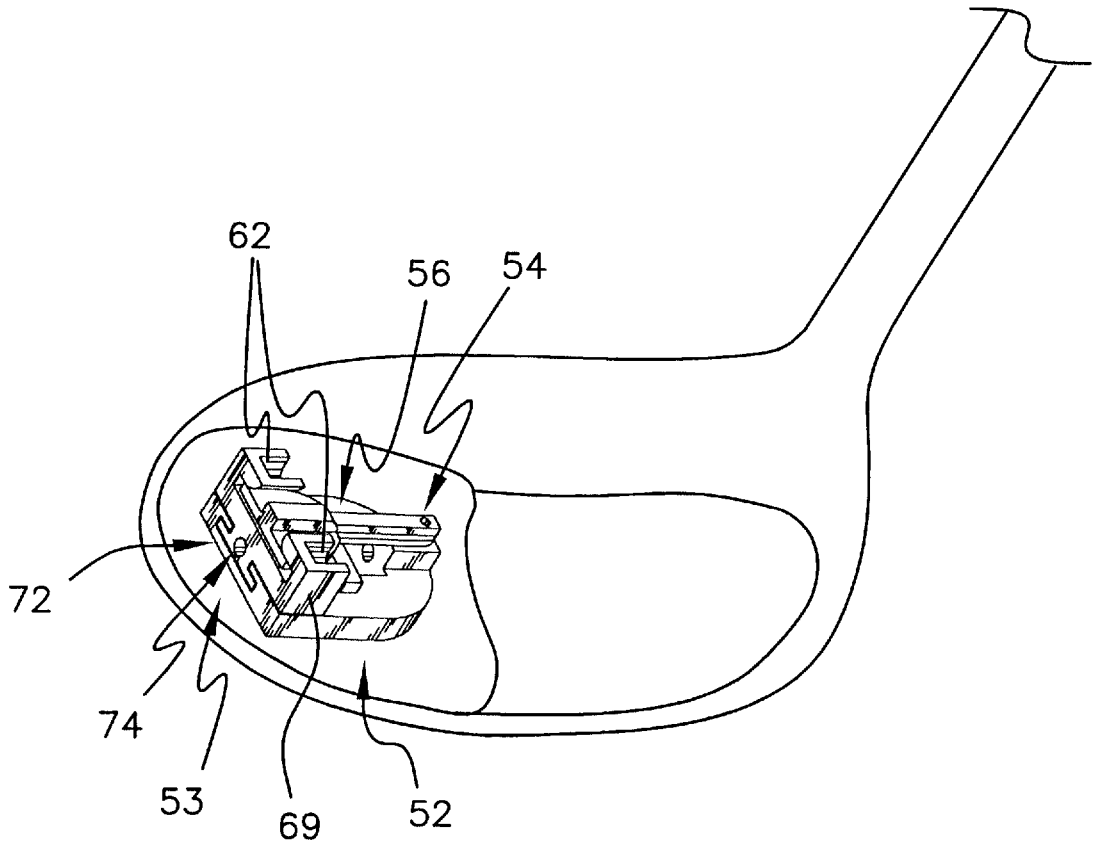
FIG. 17 is a perspective view of the golf swing training device according to the first embodiment shown in FIGS. 1–10.

The pendulum 250 has a pin 220 on its free end, farthest from the outer end 208 of the fulcrum 204. A hole 222 is provided in the outer end 224 of the arm 202. The hole 222 is disposed so that the pin 220 will line up with the hole 222 when the pendulum 250 and the fulcrum 204 are parallel and coplanar with one another, as shown in FIG. 16.

A diaphragm 230 is disposed between the arm 202 and the fulcrum 204. The diaphragm 230 is shown in greater detail in FIG. 12. The diaphragm 230 is similar to the top of a jar lid. It is circular with a lip 232 which extends from the edge of the diaphragm 230 parallel to an axis of the diaphragm. A ring 240 is positioned on the diaphragm 230 and is maintained in position by circular projection 234 which is concentric with the diaphragm 230. The diaphragm 230 is resilient enough so that it flexes when force is applied along the axis.

In operation, as the trainer is swung, centrifugal force is developed parallel to the shaft 24. The centrifugal force acts on the weight so that the fulcrum 204 pivots about the fulcrum bearing 206 towards the club head 22. The movement of the fulcrum 204 about the bearing 206 is limited by the diaphragm 230 situated on the arm 202. The ring 240 rests on the surface of the diaphragm. If the centrifugal force is great enough the weight 212 on the fulcrum 204 will create enough force against the ring 240 so that the diaphragm 230 buckle creating a popping sound. The popping sound is similar to the sound a vacuum sealed jar makes when the lid is removed. The amount of force necessary to cause the diaphragm to buckle can be varied by moving the weight 212 along the fulcrum 204. The force at which the diaphragm will buckle is determined by the position of the weight 212 at or above various club speeds. If the club is swung too slowly, then an insufficient amount of centrifugal force will be developed.

Figure 14:
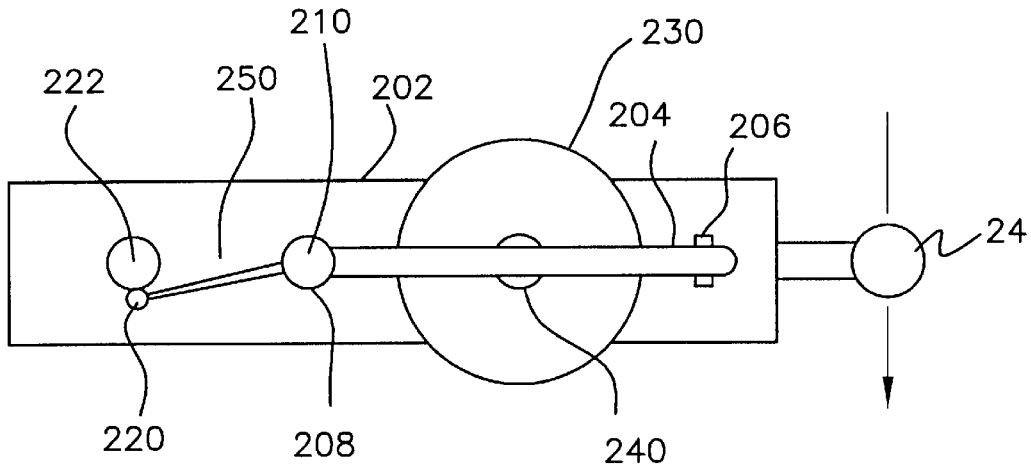
FIG. 14 is a top plan view of the device shown in FIG. 11 during a slice swing.
Figure 15:
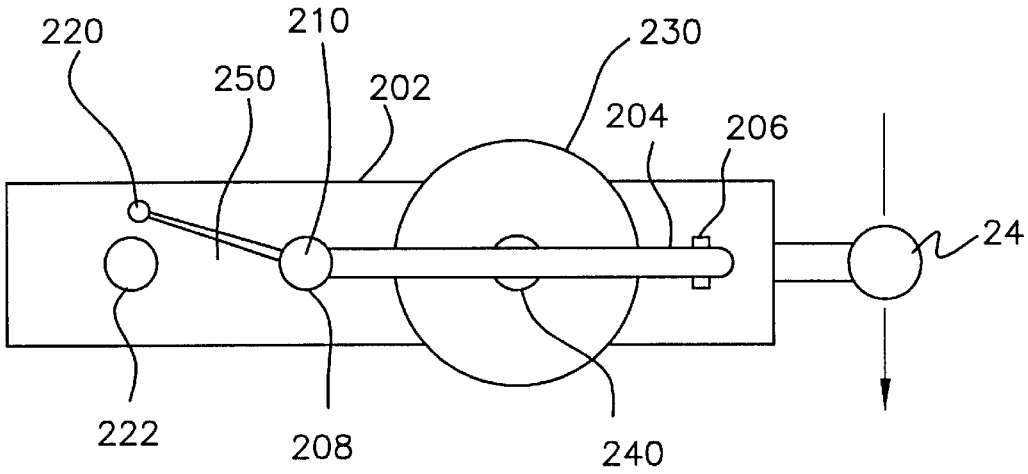
FIG. 15 is a top plan view of the device shown in FIG. 11 during a hook swing.

The diaphragm 230 will only buckle when the club head is oriented perpendicular to the club swing path at the point of intended ball impact. This is accomplished through the pendulum 250 the pin 220 and the hole 222. Referring to FIGS. 14–16, the pendulum 250 is pivotable attached to the outer end 208 of the fulcrum 204 by hinge 210. If the club head 22 is oriented perpendicular to the swing path, then at the point of intended impact the pin 220 will be parallel and coplanar with the axis of the hole 222. As a result, the fulcrum 204 is free to rotate about the bearing 206 which causes the diaphragm to buckle if sufficient centrifugal force is produced by the swing.

On the other hand, if the club head 22 is oriented so that it is not perpendicular to the swing path, the pin 220 and hole 222 will not line up. The pin 220 will instead contact the top surface of the arm 202, thereby limiting the range of movement of the fulcrum 204 about the bearing 206. As a result the diaphragm will not buckle and no audible popping sound will be produced.

FIG. 14 shows the situation where the user has swung the club at a great enough speed to develop sufficient centrifugal force but the club head is oriented so as to produce a slice. In this instance, the pin 220 strikes the top surface of the arm 202 on a side of the hole 222 closer to the club face, and no sound is produced.

FIG. 15 shows the situation where the user has swung the club at a great enough speed to develop sufficient centrifugal force but the club head is oriented so as to produce a hook. In this instance, the pin 220 strikes the top surface of the arm 202 on a side of the hole 222 farther from the club face, and no sound is produced.

Only when the club head 22 is oriented perpendicular to the swing path, to produce a straight drive, that the pin 220 and hole 222 will line up, as shown in FIG. 16. In this situation the pin 220 will drop into the hole 222 and the centrifugal force on the fulcrum 204 will be transferred to the diaphragm causing it to buckle, and thereby providing the user with an audible indication of straight drive.

Having described several embodiments of the golf swing training device in accordance with the present invention, it is believed that other modifications, variations and changes will be suggested to those skilled in the art in view of the description set forth above. For example, there are mechanical and electrical analogs to the pendulum, which is the preferred embodiment of the present invention. It is therefor to be understood that all such variations, modifications and changes are believed to fall within the scope of the invention as defined in the appended claims.

What is claimed is:

1. A golf swing training device, comprising:

a golf club having a grip, a shaft, and a club head;

a power source;

a velocity switch for sensing when said club is at peak velocity;

a pendulum, disposed in said club head;

a pair of sensors disposed on either side of said pendulum for sensing a position of said pendulum; and an electronic circuit which activates said pair of sensors when said velocity switch senses peak velocity, outputs of said pair of sensors providing data indicating orientation of a club face of said club head at said moment of peak velocity, said electronic circuit having a speaker and utilizing said outputs to produce audible indicators of said orientation of said club face at said moment of peak velocity.

2. A golf swing training device as recited in claim 1, wherein said pendulum is disposed in a plane perpendicular to an axis of said club shaft.

3. A golf swing training device as recited in claim 2, wherein a pivot of said pendulum is disposed closer to said club shaft than a free end of said pendulum.

4. A golf swing training device as recited in claim 2, wherein a width of said pendulum increases from said pivot to said free end.

5. A golf swing training device as recited in claim 4, wherein sensitivity of said electronic golf swing training device is adjustable by moving said pair of sensors toward and away from said shaft of said club.

6. A golf swing training device as recited in claim 2, wherein said pair of sensors each comprise a transmitter and a receiver, and when said pendulum pivots reception of a signal from one of said transmitters to a corresponding receiver of either one of said sensors is blocked at said moment of peak velocity, indicating that said club face is in one of a closed and open orientation.

7. A golf swing training device as recited in claim 6, wherein when said pendulum does not block either of said pair of sensors at said moment of peak velocity, said electronic circuit provides an audible indication of straight club face orientation.

8. A golf swing training device as recited in claim 7, wherein said audible indication of straight club face orientation is a sound of a ball being struck.

9. A golf swing training device as recited in claim 6, wherein when said pendulum blocks one of said pair of sensors closer to said club face, at said moment of peak velocity, said electronic circuit causes said speaker to emit an audible indication of a slice, said orientation of said club face being open.

10. A golf swing training device as recited in claim 9, wherein said audible indication of a slice is a rising whistle.

11. A golf swing training device as recited in claim 9, wherein said electronic circuit modulates said audible indication of a slice to provide an audible representation of a degree to which said club face is open.

12. A golf swing training device as recited in claim 5, wherein when said pendulum blocks one of said pair of sensors farther from said club face, at said moment of peak velocity, said electronic circuit causes said speaker to emit a audible indication of a hook, said orientation of said club face being closed.

13. A golf swing training device as recited in claim 12, wherein said audible indication of a hook is a descending whistle.

14. A golf swing training device as recited in claim 12, wherein said electronic circuit modulates said audible indication of a hook to provide an audible representation of a degree to which said club face is closed.

15. A golf swing training device as recited in claim 1, wherein said power source is at least one battery disposed in said grip.

16. A golf swing training device as recited in claim 1, further comprising an on/off switch disposed on said grip.

17. A golf swing training device as recited in claim 9, further comprising a power on indicator.

18. A golf swing training device as recited in claim 1, wherein said electronic golf swing training device has a size weight and balance of a conventional club.

19. A golf swing training device as recited in claim 1, further comprising a smoothness switch which senses when said club exceeds a preset acceleration, wherein when said golf swing training device is swung unsmoothly during one of an upswing and a downswing, said electronic circuit provides an indication of an unsmooth swing.

20. A golf swing training device as recited in claim 19, wherein said indication of said unsmooth swing is produced by disconnection of said pair of sensors from ground when said unsmooth swing occurs.

21. A golf swing training device as recited in claim 1, wherein said moment of peak velocity corresponds to a point in a golf swing where said club face meets a ball.

22. A golf swing training device, comprising:

a golf club having a grip, a shaft, and a club head;

a pendulum, disposed in a plane perpendicular to an axis of said club shaft, said pendulum being rotatable about a pivot parallel to said axis of said club shaft, and said pivot being offset from said club shaft outward toward said outer end of said club head; and means for generating an audible indication of straight orientation of a club face of said club head, at point in a swing path where a ball would be in a drive swing.

23. A golf swing training device as recited in claim 22, further comprising:

a fulcrum pivotably attached to said club by a bearing so that said fulcrum pivots up and down relative to said club head;

a hinge pivotably connecting said pendulum to said fulcrum, said hinge being disposed on an end of said fulcrum opposite said bearing;

a pin disposed on said a free end of said pendulum;

a hole in a surface below said fulcrum disposed so that when said pendulum is parallel to said fulcrum said pin is free to move into said hole; and a diaphragm disposed below said fulcrum, wherein when said pin and said hole are aligned and said club is swung so as to create sufficient centrifugal force, said fulcrum swings downward causing said diaphragm to buckle and produce an audible indication of a straight swing.

24. A golf swing training device as recited in claim 23, further comprising an arm disposed above said club head, said fulcrum being pivotably attached to said arm, and said diaphragm being disposed below said arm.

25. A golf swing training device as recited in claim 24, wherein said hole is disposed in said arm.

26. A golf swing training device as recited in claim 23, further comprising a ring disposed on said diaphragm for transferring force from said fulcrum to said diaphragm.

27. A golf swing training device as recited in claim 23, further comprising a weight movably attached to said fulcrum to adjust a minimum speed with which said golf swing trainer must be swung to produce said audible indication.

28. A golf swing training device as recited in claim 23, wherein when said club face is not oriented perpendicular to said swing path said pin and said hole are misaligned, said misalignment preventing said fulcrum from rotating about said bearing so that said diaphragm does not buckle and no audible indication is produced.

* * * * *